United States Patent [19]

Peters et al.

[11] 3,998,705

[45] Dec. 21, 1976

[54] DEVICE FOR CONTROLLING THE SEIZURE OF A COVER FOR THE CHARGE OPENING OF A COKING FURNACE

[75] Inventors: Josef Peters, Bochum-Oberdahlhausen; Günter Gebhardt, Dortmund, both of Germany

[73] Assignee: Klockner-Humboldt-Deutz AG, Germany

[22] Filed: Oct. 7, 1974

[21] Appl. No.: 512,902

[30] Foreign Application Priority Data

Oct. 11, 1973 Germany ..... 2351045

[52] U.S. Cl. ..... 202/251; 214/18 PH

[51] Int. Cl.[2] ..... C10B 31/00; B66C 17/08

[58] Field of Search ..... 202/250, 251, 270; 294/65.5; 214/18 PH; 212/4

[56] References Cited

UNITED STATES PATENTS

| | | | |
|---|---|---|---|
| 3,160,573 | 12/1964 | Nepomniashtshy | 214/18 PH |
| 3,182,838 | 5/1965 | Brandenbusch | 202/251 |
| 3,536,205 | 10/1970 | Bender | 214/18 PH |
| 3,753,502 | 8/1973 | Abendroth | 202/251 |
| 3,774,787 | 11/1973 | Ledinsky | 214/18 PH |

FOREIGN PATENTS OR APPLICATIONS

| | | | |
|---|---|---|---|
| 2,226,983 | 4/1973 | Germany | 202/251 |

*Primary Examiner*—Jack Sofer
*Attorney, Agent, or Firm*—Hill, Gross, Simpson, Van Santen, Steadman, Chiara & Simpson

[57] ABSTRACT

A device for seizing and transporting a cover for the charge opening of a coking furnace comprises a seizure magnet carried by a gripping unit and adapted for rotation of the cover back and forth on the cover seat in the charge opening by means of a crank device connected with said gripping unit which in turn is suspended from a linkage means connecting said gripping unit with a slide arrangement for moving the magnet and the cover away from and into the furnace charging region, a force sensing overload safety device being connected with said linkage means in such a manner as to prevent operation of the slide arrangement when the force transmitted to said force sensing overload safety device by said gripping unit exceeds a predetermined value, thereby preventing damage in case of excessively strong adherence of the cover to its seat in the charge opening.

7 Claims, 2 Drawing Figures

Figure 1:
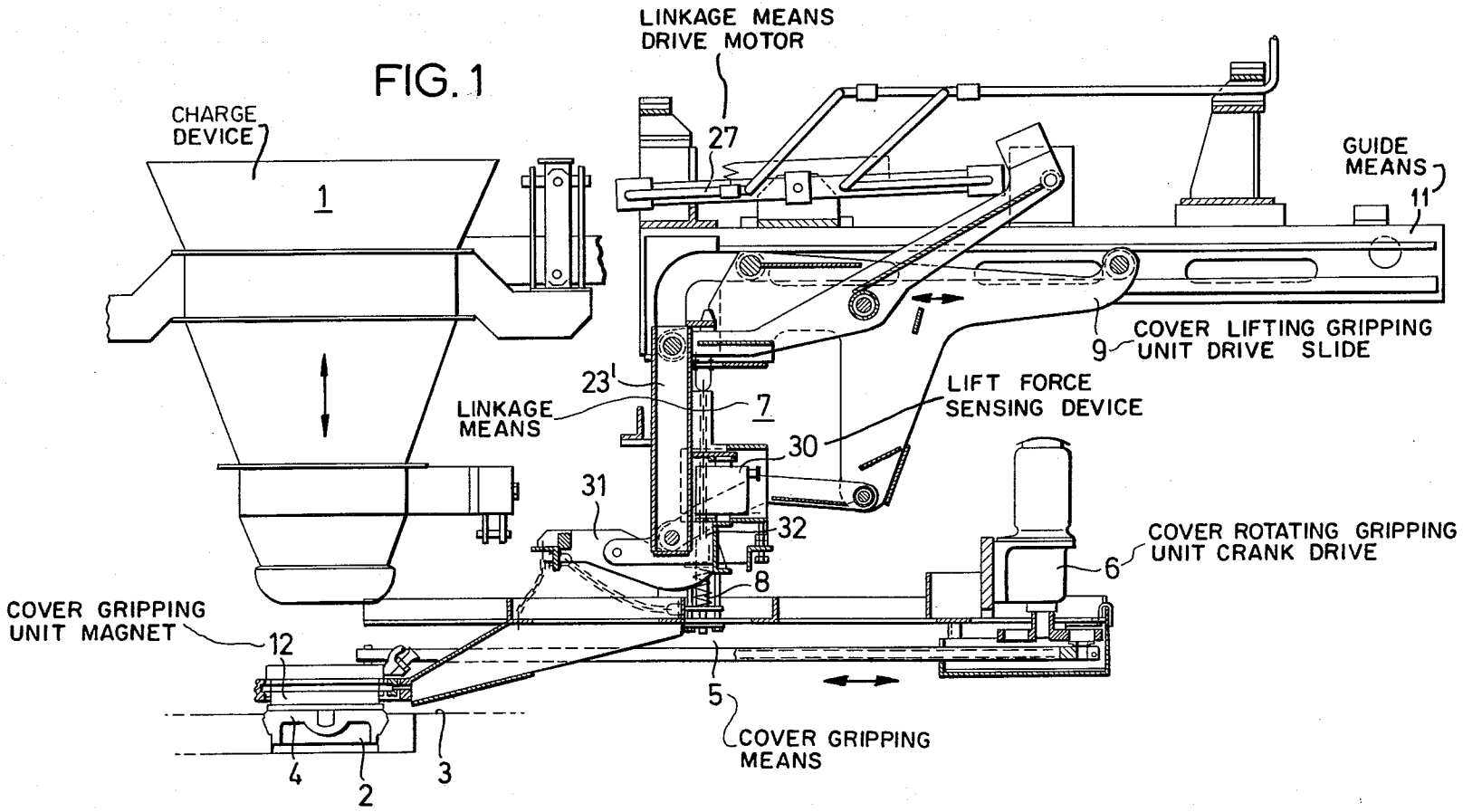

DEVICE FOR CONTROLLING THE SEIZURE OF A COVER FOR THE CHARGE OPENING OF A COKING FURNACE

The invention relates to a device for magnetic lifting of the charge opening cover in a coking furnace and for removal of said cover from the charging region by means of a magnetic gripping unit which is connected with a crank drive for rotating the cover back and forth and with a drivable slide through a linkage means which is so coupled with the slide drive means that the latter first lifts the charge opening cover and then moves the slide, as disclosed in patent application Ser. No. 460,464, filed Apr. 12, 1974.

From the published German patent application 2,226,983 there is known a device for lifting the charge opening cover, said lifting device being mounted on a coking furnace charging carriage and for seizure control of the charge opening cover provided with an indicator device which essentially comprises a feeler arm which by bell crank levers is connected with an adjustment rod which, when the cover has been seized and the lifting device has been moved upwardly, actuates an electrical control switch secured to said charging carriage. In connection with lifting devices for charge opening covers which perform a purely vertical lifting movement, said indicator device is entirely satisfactory. It is, however, not sufficient in connection with wholly automatically controlled removal devices in which the charge opening cover prior to the lifting of the same from its seat is rotated free and then raised and slid or swung away from the charge opening region.

It is the object of the invention to provide a device for seizure control of the charge opening cover particularly in connection with fully automatically regulated magnetic removal means, which device in a simple and operationally safe way provides control of whether the cover has been rotated free from its seat and seized by the lifting device.

It is a further object of the invention to protect the lifting device against overloads detrimental to the operation as, for example, in case the charge opening cover has become stuck and is impossible to remove.

According to the invention, the problem is solved by connecting a force sensing device with the gripping unit and the above mentioned linkage means. This arrangement provides in a structurally advantageous manner and with utilization of the force of gravity a reliable indication as to whether the charge opening cover has been seized by the gripping unit, said indication also being independent of the spatial dimensions of the cover structure. It also involves the advantages that accurate positioning of the cover is not necessary, and that it becomes feasible by means of the force sensing device to determine whether a jammed cover may place too heavy strains on the lifting unit to the detriment of the operation. In such a case, an overload safety mechanism is preferably actuated which locks, i.e. prevents operation of, the slide driving means and thus at an early stage prevents overloading and possible damage. Preferably, the gripping unit is connected with the linkage means and the force sensing device in the region of its center of gravity.

According to the invention the gripping unit is connected with the linkage means through a lever pivotally secured to said linkage means, and the force sensing device is arranged between at least one of the arms of said lever and the linkage means. This advantageous arrangement makes it possible by suitable selection of the lengths of the lever arms to provide any desired translation ratio, so that force sensing devices of any desired sensitivity can be used for the control indication. Preferably, the lever is mounted on a coupling arm of the linkage means, and the force sensing device is supported on said coupling arm.

In additional development of the invention the force sensing device comprises an adjustable spring arrangement which results in a particularly simple and readily attended structure by means of which charge opening covers of widely varying weight may be safely transported. Said spring arrangement is advantageously so adjusted as to counterbalance the weight of the gripping unit when the cover is seized. This equilibrium condition is preferably calibrated on a control scale, so that all scale readings deviating therefrom indicate either non-seizure of the charge opening cover or excessive strains on the removal device.

In a further preferred embodiment of the invention the lever is provided with an actuation device for a limit switch for seizure control of the charge opening cover. This device has in particular the advantage of a safe control possibility, optical or acoustic, as to whether the charge opening cover is supported by the gripping unit, whereby possible errors in reading measuring scales are essentially avoidable.

Figure 2:
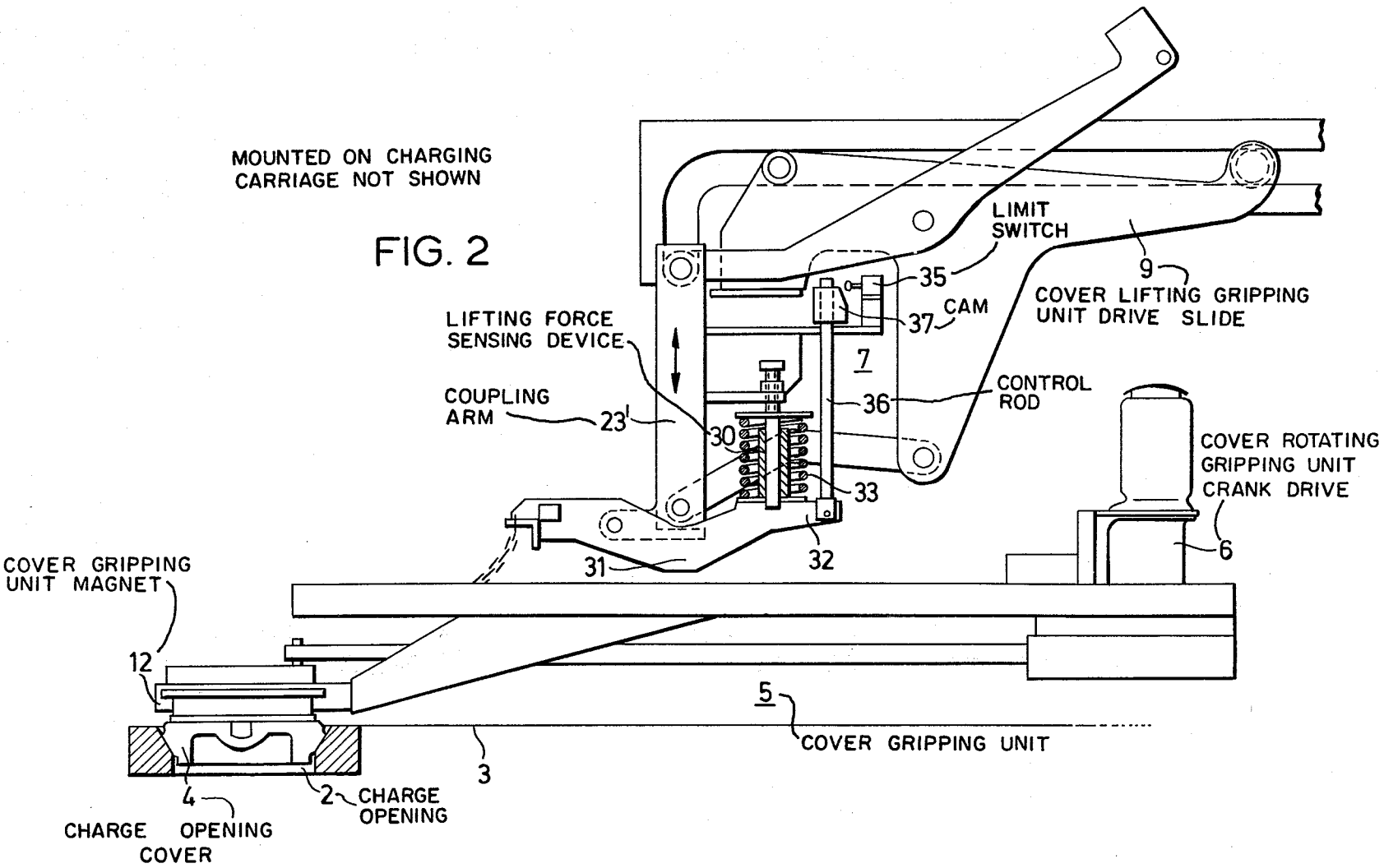

Further details, features and advantages of the invention will be explained below with reference to the accompanying drawings which show embodiments of said invention, and in which:

FIG. 1 is a side view of an embodiment with the inventive force sensing device, and FIG. 2 shows, on a somewhat larger scale, a side view of an embodiment of a force sensing device according to the invention which includes a spring and a limit switch.

In FIG. 1, reference numeral 1 indicates a charging, or filling, device which is coordinated with the charge opening 2 in the furnace roof 3 and mounted on a charging carriage (not shown) which is movable on the furnace roof. For charging of the coal into the furnace chamber the charging device 1 is lowerable from the charging carriage onto the charge opening 2 in the furnace roof 3. A charge opening cover 4 is applicable to the charge opening 2 and must be removed therefrom prior to the lowering of the charging device and the ensuing charging of the furnace chamber. For this purpose there is provided a cover removal device which comprises a gripping unit 5 with a magnet 12 and a crank drive 6 for rotation of the cover back and forth. Said gripping unit is connected with a device 7 comprising two parallel links and herein called a linkage means from which the gripping unit is suspended by means of a spring 8. Said linkage means 7 is, in turn, connected with a drivable slide 9 in such a manner that the gripping unit 5 first lifts up the charge opening cover 4 and then transports it away from the region of the charging device 1. The cover removal means comprising the gripping unit 5, the linkage means 7 and the slide 9, is mounted on the substructure (not shown) of the abovementioned coke furnace charging carriage. The cover lifting gripping unit driven slide rides in guide means 11.

In the position of the cover removal device shown in FIG. 1 the charging device 1 with its pouring funnel is disposed above the charge opening 2 in the furnace roof 3 and a funnel shut-off member for the coal in the charging device 1 is still closed. During this stage the charge opening cover 4 is in operative connection with the magnet 12 of the gripping unit 5, is being reciprocably rotated loose from its seat by means of the crank drive 6 and then by means of the linkage means 7 and slide 9 first lifted and thereafter transported horizontally along the furnace roof 3. For seizure control of the cover 4 the gripping unit is connected with the linkage means 7 over a lever 31 which is pivotally mounted on said linkage means, and on one of the arms 32 of said lever 31 a force sensing device 30 according to the invention is mounted which is supported on a coupling arm 23' of the linkage means 7 and electrically connected with an indicator or control gauge that is not shown in detail.

As shown in FIG. 2, the force sensing device comprises a coil spring 33 which is mounted on the arm 32 of the lever 31 and supported on the coupling arm 23' of the linkage means 7, the spring characteristics being variable by means of an adjustable disc and screw arrangement, the construction of which is well known in the art. On the lever arm 32 there is provided a control rod 36 carrying a cam 37 which is adapted for coaction with a limit switch 35 secured to the coupling arm 23' and actuated by means of said cam 37 for lifting control, when the charge opening cover 4 is seized by the magnet 12. The limit switch actuator cam 37 is provided with an inclined surface, as shown, for coaction with the limit switch actuator. When the linkage means drive motor 27 is activated and begins raising the coupling arm 23' and the arm of lever 31 pivotally connected therewith, the chains connecting said lever 31 with the gripping unit 5 are straightened from the slightly sagging condition indicated in the drawing, thus causing the combined weight of the gripping unit 5 and the cover 4 to turn the arm 32 of lever 31 upwardly and thereby to compress spring 33 and bring the inclined surface of cam 37 into contact with the actuator of switch 35. If at this stage the cover 4 is readily removable from its seat, the switch 35 remains unactivated and the removal of the cover 4 continues without interruption by the sliding movement of the linkage means 7 along its guide track.

However, should the lifting of the cover 4 from its seat require more than the normal force as, for example, due to abnormally strong adherence to the seat, the spring 33 will be increasedly compressed with the result that control rod 36 and cam 37 will continue upwardly with the switch actuator sliding further along the inclined cam surface and causing the switch to interrupt the operation of the linkage means drive motor 27. Accordingly, the sensing device 30 effectively and automatically protects the system from damage due to overload.

The inventive construction of the device for the seizure control of the charge opening cover of coking furnaces is not limited to the embodiments described above as examples but is also advantageously utilizable within the framework of the invention in connection with lifting devices by means of which the charge opening cover is first turned free, then lifted and finally swung laterally out of the charging region, the force sensing device in such a case being arranged between the gripping unit and the swinging means.

We claim as our invention:

1. A device for magnetic lifting of the charge opening cover of a coking furnace and removal of said cover from the charging region by means of a gripping unit with magnet, comprising:
   a. a crank device connected with said magnet for rotating the charge opening cover back and forth,
   b. a linkage means connecting said magnet with a drivable slide having drive means,
   c. means connecting said linkage means with the slide drive means in such a way as to cause said drive means to first lift the gripping unit with the charge opening cover and then move said slide, and
   d. a force sensing overload safety device connected between said gripping unit and said linkage means and operative to prevent operation of said drive means should the cover become stuck and resist removal of the cover from said charge opening by said gripping unit.

2. A device according to claim 1, in which said linkage means and said overload safety device are connected with said gripping unit at substantially its center of gravity in such a manner as to render the gripping unit substantially balanced when carrying the charge opening cover.

3. A device according to claim 1, in which said force sensing overload safety device includes an adjustable spring arrangement.

4. A device according to claim 1, in which said force sensing overload safety device is connected between the linkage means and an arm of a lever which is pivotally mounted on said linkage means and is connected with said gripping unit.

5. A device according to claim 3, in which said lever is mounted on a coupling arm of said linkage means and said force sensing overload safety device is supported on said coupling arm.

6. A device according to claim 3, in which said force sensing overload safety device includes a limit switch and said lever is provided with an actuator for operating the limit switch in response to sticking of the cover on its seat to cut off energization of the magnet.

7. In a device for seizing and transporting a charge opening cover for a coking furnace,
   a. a magnet adapted to seize and retain said cover,
   b. a gripping unit secured to said magnet,
   c. a crank device connected with said gripping unit and adapted to rotate said cover back and forth on its seat in the charge opening,
   d. a transportation slide mounted for movement on guide means by means of a drive motor,
   e. linkage means connecting said slide with said gripping unit for moving said magnet into and out of the region of said charge opening, and
   f. a force sensing overload safety device connected with said linkage means in such a manner as to prevent said drive motor from moving said slide when the force transmitted through said linkage means exceeds a predetermined value, whereby to prevent damage in case of excessively strong adherence of said charge opening cover to its seat in the charge opening.

* * * * *